US012746953B2

(12) United States Patent
Melvin

(10) Patent No.: US 12,746,953 B2
(45) Date of Patent: Sep. 29, 2026

(54) RAILCAR TAB GASKET AND PROCESS OF MANUFACTURE

(71) Applicant: Gasket Resources Inc., Downingtown, PA (US)

(72) Inventor: Lee Melvin, La Porte, TX (US)

(73) Assignee: Gasket Resources, Inc., Downingtown, PA (US)

( * ) Notice: Subject to any disclaimer, the term of this patent is extended or adjusted under 35 U.S.C. 154(b) by 597 days.

(21) Appl. No.: 18/201,444

(22) Filed: May 24, 2023

(65) Prior Publication Data

US 2023/0382438 A1 Nov. 30, 2023

Related U.S. Application Data

(60) Provisional application No. 63/346,609, filed on May 27, 2022.

(51) Int. Cl.
*B61D 39/00* (2006.01)
*B61D 17/16* (2006.01)

(52) U.S. Cl.
CPC ..... *B61D 39/008* (2013.01); *B61D 17/16* (2013.01)

(58) Field of Classification Search
CPC ..... B61D 17/16; B61D 39/008
See application file for complete search history.

(56) References Cited

U.S. PATENT DOCUMENTS 1,807,258 A 5/1931 Schwartz
1,903,785 A 4/1933 Lillig
1,942,704 A 1/1934 Hubbard et al.
(Continued)

FOREIGN PATENT DOCUMENTS

CN 1453097 11/2003
CN 104325841 2/2015
(Continued)

OTHER PUBLICATIONS

Evans, "Sealing tank car manways to prevent NARs", Railway Age, obtained from https://www.railwayage.com/regulatory/sealing-tank-car-manways-to-prevent-nars/, Aug. 22, 2016.
(Continued)

*Primary Examiner* — Robert J McCarry, Jr.
(74) *Attorney, Agent, or Firm* — Stradley Ronon Stevens & Young, LLP

(57) ABSTRACT

A gasket that prevent leaks around the mating surface where two or more objects meet. The gasket includes a substantially planar horizontal top surface defining a body under the top surface; a substantially planar horizontal bottom surface substantially parallel to the top surface; a substantially planar vertical edge extending between the top surface and the bottom surface to define the height or thickness of the gasket; and a step that is integral with the body and has an "L" shape defined by a substantially planar vertical leg and a substantially planar horizontal leg, the step having a bottom and ending in a substantially planar vertical edge that extends between the bottom surface and the horizontal leg to define the height of the step, with the bottom of the step flush with the bottom surface of the gasket. Also disclosed are processes for manufacturing and a railway car including the gasket.

15 Claims, 9 Drawing Sheets

(56) References Cited

U.S. PATENT DOCUMENTS

| | | | | |
|---|---|---|---|---|
| 2,745,362 | A | 5/1956 | Lunde | |
| 3,939,551 | A | 2/1976 | Clark et al. | |
| 4,243,235 | A | 1/1981 | Repella | |
| 4,723,350 | A | 2/1988 | Kobayashi et al. | |
| 5,622,117 | A | 4/1997 | Burian et al. | |
| 5,659,876 | A | 8/1997 | Mizuta | |
| 5,964,488 | A | 10/1999 | Bedel | |
| 6,050,199 | A | 4/2000 | Anderson et al. | |
| 6,494,338 | B1 * | 12/2002 | Schultz | B65D 90/10 220/221 |
| 8,397,646 | B2 | 3/2013 | Blevins, Jr. | |
| 9,701,058 | B2 | 7/2017 | Valle et al. | |
| 9,908,536 | B2 | 3/2018 | Sandheinrich et al. | |
| 10,486,718 | B2 | 11/2019 | Ozerdim et al. | |
| D893,685 | S | 8/2020 | Evans | |
| 2005/0121859 | A1 | 6/2005 | Seidel et al. | |
| 2006/0078401 | A1 | 4/2006 | Rycroft | |
| 2007/0183867 | A1 | 8/2007 | Hesselmann et al. | |
| 2021/0238889 | A1 | 8/2021 | Maki | |

FOREIGN PATENT DOCUMENTS

| | | |
|---|---|---|
| CN | 104400356 | 3/2015 |
| CN | 205533715 | 8/2016 |
| CN | 206785845 | 12/2017 |
| CN | 207500292 | 8/2018 |
| CN | 108730315 | 11/2018 |
| CN | 109538605 | 3/2019 |
| CN | 109764054 | 5/2019 |
| CN | 110259810 | 9/2019 |
| CN | 209671448 | 11/2019 |
| CN | 111720421 | 9/2020 |
| CN | 112727881 | 4/2021 |
| CN | 214331108 | 10/2021 |
| CN | 214578819 | 11/2021 |
| CN | 214698675 | 11/2021 |
| CN | 113833736 | 12/2021 |
| CN | 113864319 | 12/2021 |
| CN | 215567199 | 1/2022 |
| GB | 1494214 | 12/1977 |
| JP | 2022026470 | 2/2022 |
| KR | 1020070081347 | 8/2007 |
| WO | 2021224979 | 11/2021 |

OTHER PUBLICATIONS

Henmi 25076RP Washer and Ring Kit for 1½in Fittings, O-Ring Rubber Washer for Intex Pool Plunger Valves and Intex Replacement Gasket (6 pcs)—10745, 10262 and 10255, https://www.amazon.com/HENMI-25076RP-Fittings-Plunger-Replacement/dp/B084JN4DR4, Feb. 6, 2020 Obtained Oct. 18, 2023.

Darcoid, Lathe Cut Gaskets, https://web.archive.org/web/20210517103917/https://www.darcoid.com/products/sealing-products/gaskets/lathe-cut-gaskets, 2021, obtained Oct. 19, 2023.

The rubber company, Lathe cut gaskets and Seals, https://web.archive.org/web/20210127153226/https://therubbercompany.com/gaskets-and-seals/lathe-cut-gaskets, 2019, obtained Oct. 19, 2023.

Advertisement for "Durlon Sealing Solutions 9000" by Triangle Fluid Controls Ltd. (Jul. 2020).

Advertisement for "The Origin RC510 Gasket" by Teadit (Feb. 2018).

Appendix E of the AAR Manual of Standards and Recommended Practices Specifications for Tank Cars at C-III [M-1002] 326 (Nov. 2014).

Advertisement titled "Case Study: Gylon 3504 Tuff-Rail Fill Hatch Gasket—Chemical" by Garlock (Nov. 2022).

Advertisement titled "Manway Gaskets for the Rail Industry" by Parker Hannifin Corporation (2014).

* cited by examiner

RAILCAR TAB GASKET AND PROCESS OF MANUFACTURE

RELATED APPLICATION

This application claims the benefit of priority to U.S. Provisional Patent Application Ser. No. 63/346,609, filed on May 27, 2022, the contents of which are incorporated in this application by reference.

TECHNICAL FIELD

The present disclosure relates generally to gaskets and processes of manufacturing gaskets and, more particularly, to gaskets used to seal a hatch cover for a covered railroad car.

BACKGROUND OF THE DISCLOSURE

Polytetrafluoroethylene ("PTFE") gaskets are commonly used to seal flanged joints in industrial applications because of their chemical resistance to many media products and their mechanical properties for electrical insulation, anti-stick, impact resistance, and low friction coefficient. Generally, the methods of manufacturing PTFE gaskets involve stamping out circular gaskets of a desired size from a sheet of PTFE. After the circular gaskets have been removed from the PTFE sheet, the remainder of the PTFE sheet is waste, which can amount to about 40% to 60% of the PTFE sheet. These manufacturing methods produce gaskets that are limited in size by the machinery used and may be weak due to splices formed within large size gaskets. These manufacturing methods also produce large amounts of PTFE sheet waste, which can increase manufacturing costs.

U.S. Pat. No. 9,701,058 assigned to Teadit N. A., Inc. of Pasadena, Texas, discloses a spiral-wound PTFE gasket and a method of manufacturing that gasket. The method includes winding a laminated PTFE tape around a shaft that has an outer diameter that coincides with the gasket inner diameter to create a PTFE cylinder having an outer diameter that coincides with the gasket outer diameter; sintering the PTFE cylinder; and removing a radial segment of the PTFE cylinder to form the gasket. The radial segment has a thickness that coincides with the gasket thickness. The assignee sells its gasket as the Origin™ RC510 gasket, and states that the gasket was developed with the challenges of railroad car service in mind.

Railroad cars (or railcars) have been used for many years to transport a wide variety of commodities as cargo or lading during shipment. Railcars include boxcars, freight cars, hopper cars, gondola cars, tank cars, and temperature-controlled railway cars. Covered railcars transport solid flowable materials such as, for example, plastic pellets, coal, grains, food products, powder, rock, cement, sand, metal ores, aggregates, and other materials within one or more compartments in the railcars. More specifically, covered tank cars transport fluids such as crude oil, styrene, biofuels, fuel oil, sodium hydroxide, and other materials within one or more compartments. Each compartment has at least one hatch, port, or opening in the roof of the railcar at the top of the compartment to facilitate gravity loading of the materials into the compartment (and, more generally, access to the compartment).

A variety of door assemblies or gate assemblies along with various operating mechanisms have been used to open and close the hatches associated with covered railcars. A pivotable hatch cover which is typically hinged on one side is often provided for each hatch to close the compartment after loading and thereby prevent foreign matter and the elements (e.g., moisture) from entering the compartment and contaminating the stored materials during transit. The hatch cover is typically secured in its closed position with a hatch cover lock, eyebolts, or both.

It has been known to use a gasket to seal the connection between the hatch cover and the hatch. The act of closing the hatch cover compresses a gasket between the inside of the hatch cover and a coaming of the railcar, thereby sealing the hatch cover over the hatch of the railcar. Generally, the gasket is adhesively attached to the hatch cover. Use of an adhesive, however, prohibits or hinders the removal of the gasket when the gasket becomes dirty or worn.

It has also been known to provide a hatch cover with a removable gasket as disclosed in U.S. Pat. Nos. 2,745,362 and 5,622,117. Both patents disclose a non-adhesive retention mechanism for supporting the gasket on the cover. The '362 patent shows annular ribs extending from opposed flanges and underlying the edges of the gasket; the '117 patent uses clips that extend from the flanges and hold the gasket in place.

U.S. Pat. No. 6,050,199 assigned to Zeftek, Inc. of Montgomery, Illinois, discloses a sealing device for a hatch cover closing a hatch on a railcar. The hatch cover includes a pocket for receiving a gasket. The pocket includes projections mating with recesses on the gasket or projections on the gasket mating with recesses in the pocket for removably retaining the gasket in the pocket.

One problem with the use of ribs, clips, or projections as shown in the '362, '117, and '199 patents is that contaminants from the outside air and contents within the railcars can accumulate between the ribs, clips, or projections and the gasket, thereby deteriorating the sealant quality of the gasket. Furthermore, cleaning of the hatch-engaging face of the gasket requires removal of the gasket from the cover for cleaning under the ribs, clips, or projections. Accordingly, there is a need for a gasket to be used in hatch covers that eliminates the problems associated with using adhesives, with deterioration of the sealant qualities, and with cleaning the gasket.

One issue that may be encountered during service is that the gasket may become worn out over time and not provide a sufficient seal between the hatch cover and the railcar coaming, thus allowing rain or debris to enter the railcar and damage the commodity. One solution to this problem is to replace the gasket with a new one. A replacement gasket may not be readily available, however, at the time or place where it is required. A related problem is that an inventory of correctly sized gaskets must be maintained.

A need remains for a gasket that can be installed and removed easily from applications such as railcars. An object of the present disclosure is to provide a gasket that meets this need. Another object is to minimize the volume and severity of leaks if not eliminate entirely the risk of leaks from railcars. Still another object is to provide a gasket having excellent sealability and elevated torque retention, outstanding recovery, and superior resistance to a wide array of media including chemicals. A related object is to provide a gasket that is rugged, robust, and durable, allowing for long life in service. Yet another object is to provide a gasket and a process of manufacturing the gasket that are environmentally friendly, practical, and affordable; eliminate wasteful consumption of material; and promote reduction of scrap material.

SUMMARY OF THE DISCLOSURE

To meet this and other needs, to achieve these and other objects, and in view of its purposes, the present disclosure provides a gasket that prevent leaks around the mating surface where two or more objects meet. The gasket includes a substantially planar horizontal top surface defining a body under the top surface; a substantially planar horizontal bottom surface substantially parallel to the top surface; a substantially planar vertical edge extending between the top surface and the bottom surface to define the height or thickness of the gasket; and a step that is integral with the body and has an "L" shape defined by a substantially planar vertical leg and a substantially planar horizontal leg, the step having a bottom and ending in a substantially planar vertical edge that extends between the bottom surface and the horizontal leg to define the height of the step, with the bottom of the step flush with the bottom surface of the gasket. Also disclosed are processes for manufacturing the gasket and a railway car including the gasket.

It is to be understood that both the foregoing general description and the following detailed description are exemplary, but are not restrictive, of the disclosure.

BRIEF DESCRIPTION OF THE DRAWING

The disclosure is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures:

FIG. 7A illustrates the manway cover having a gasket-receiving pocket but without a gasket in place;

FIG. 7B illustrates the manway cover shown in FIG. 7A with the gasket snapped into place within the gasket-receiving pocket and with the manway cover in its open position and not closed against the manway nozzle;

FIG. 7C illustrates the manway cover shown in FIG. 7A in position over (so that the manway cover closes) the manway nozzle, and bolted with eyebolts, with the gasket in place;

FIG. 8A shows a hard gasket retained on the inner diameter of the manway cover;

FIG. 8B shows a hard gasket retained on the outer diameter of the manway cover;

FIG. 8C shows an elastomeric gasket retained on both the inner and outer diameters of the manway cover:

DETAILED DESCRIPTION OF THE DISCLOSURE

Figure 1:
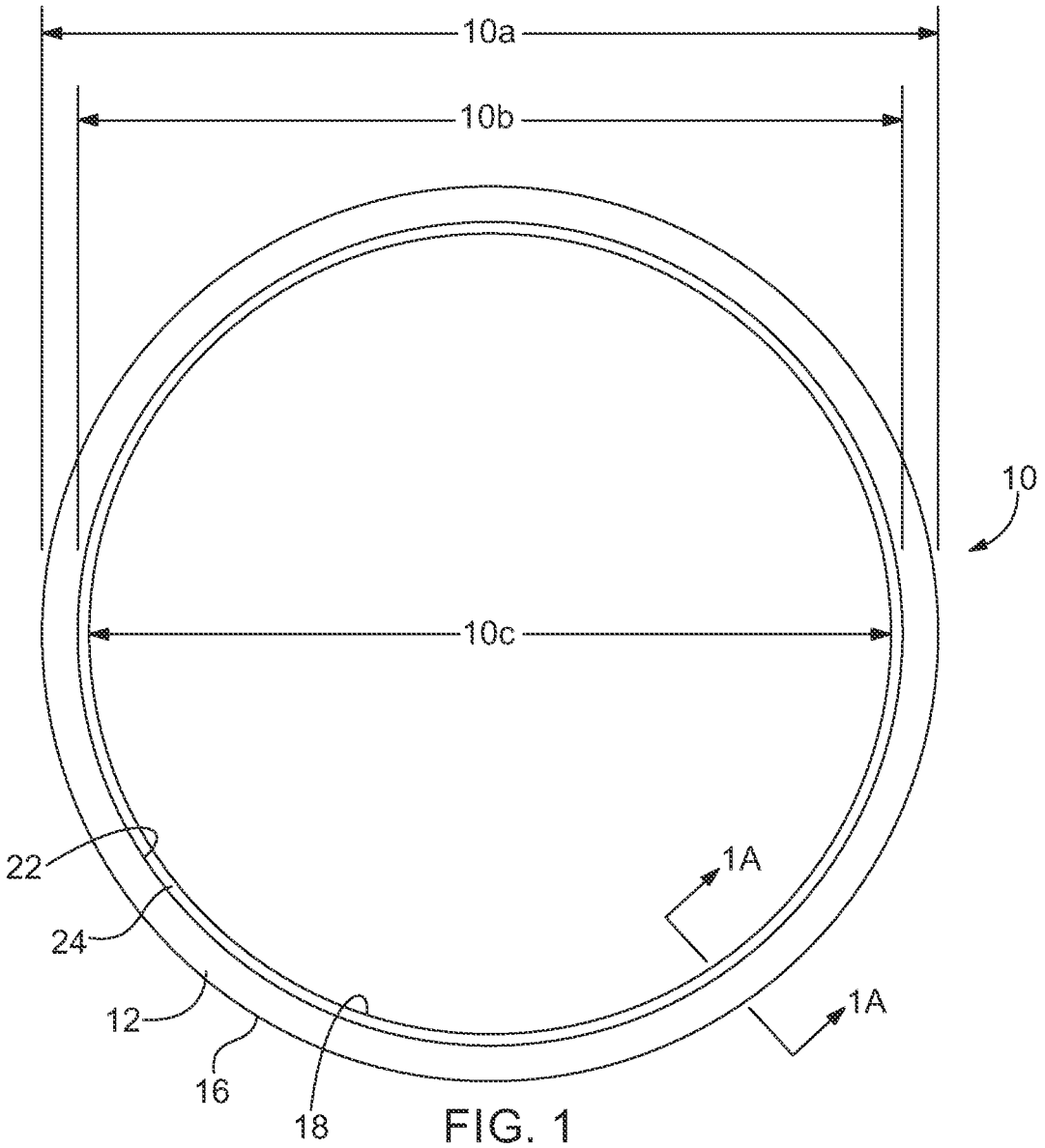
FIG. 1 is a top view of a first embodiment of a gasket according to the present disclosure.

In this specification and in the claims that follow, reference will be made to a number of terms which shall be defined to have the following meanings ascribed to them. The term "substantially," as used in this document, is a descriptive term that denotes approximation and means "considerable in extent" or "largely but not wholly that which is specified" and is intended to avoid a strict numerical boundary to the specified parameter. Referring now to the drawing, like reference numbers refer to like elements throughout the various figures that comprise the drawing. Directional terms and spatial references as used in this disclosure such as, for example, "up," "down," "right," "left," "front," "back," "top," "bottom," "upper," "lower," "above," "below," "between," "vertical," "horizontal," "angular," "upwards," "downwards," and the like are made only with reference to the figures as drawn, are not intended to imply absolute orientation, are for the purpose of illustration only, and do not limit the specific orientation or location of the structure described and illustrated.

The term "about" means those amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When a value is described to be about or about equal to a certain number, the value is within ±10% of the number. For example, a value that is about 10 refers to a value between 9 and 11, inclusive. When the term "about" is used in describing a value or an end-point of a range, the disclosure should be understood to include the specific value or end-point. Whether or not a numerical value or end-point of a range in the specification recites "about," the numerical value or end-point of a range is intended to include two embodiments: one modified by "about" and one not modified by "about." It will be further understood that the end-points of each of the ranges are significant both in relation to the other end-point and independently of the other end-point.

The term "about" further references all terms in the range unless otherwise stated. For example, about 1, 2, or 3 is equivalent to about 1, about 2, or about 3, and further comprises from about 1-3, from about 1-2, and from about 2-3. Specific and preferred values disclosed for components and steps, and ranges thereof, are for illustration only; they do not exclude other defined values or other values within defined ranges. The components and process steps of the disclosure include those having any value or any combination of the values, specific values, more specific values, and preferred values described.

The indefinite article "a" or "an" and its corresponding definite article "the" as used in this disclosure means at least one, or one or more, unless specified otherwise. "Include," "includes," "including," "have," "has," "having," comprise," "comprises," "comprising," or like terms mean encompassing but not limited to, that is, inclusive and not exclusive.

In the disclosure that follows, specific embodiments are described with respect to the gasket. Then various processes of manufacturing the gasket are described. Finally, one specific example application for the gasket is described.

First Embodiment of Gasket

Figure 1A:
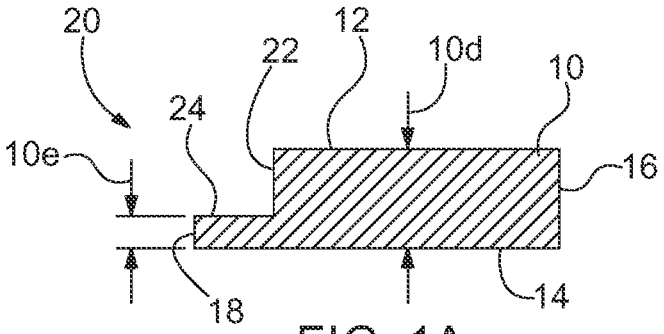
FIG. 1A is a cross-sectional view taken along the line 1A-1A of FIG. 1.

FIG. 1 is a top view of a first embodiment of a gasket, generally identified by the reference numeral 10, according to the present disclosure. FIG. 1A is a cross-sectional view taken along the line 1A-1A of FIG. 1. The gasket 10 has a substantially planar (flat) horizontal top surface 12 and a substantially planar (flat) horizontal bottom surface 14. The top surface 12 and the bottom surface 14 are substantially parallel. A substantially planar (flat) vertical outer edge 16 extends between the top surface 12 and the bottom surface 14 to define the height or thickness 10*d* of the gasket 10. The gasket includes an inner step 20 that has an "L" shape defined by a substantially planar (flat) vertical leg 22 and a substantially planar (flat) horizontal leg 24. The inner step 20 ends in a substantially planar (flat) vertical inner edge 18 that extends between the bottom surface 14 and the horizontal leg 24 to define the height 10*e* of the step 20 of the gasket 10. The length of the vertical leg 22 of the step 20 can be calculated as the thickness 10*d* minus the height 10*e*. The bottom of the step 20 is integral (flush) with the bottom surface 14 of the gasket 10 (i.e., the bottom of the step 20 and the bottom surface 14 lie in the same horizontal plane).

The outer edge 16 and the inner edge 18 are substantially parallel. The vertical leg 22 is substantially parallel to the outer edge 16 and to the inner edge 18. The horizontal leg 24 is substantially parallel to the top surface 12 and to the bottom surface 14. The integral combination of the step 20 with the body (defined as that portion of the gasket 10 that lies under the top surface 12) forms the gasket 10. By "integral" is meant a single piece or a single unitary part that is complete by itself without additional pieces, i.e., the part is of one monolithic piece formed as a unit without another part.

The gasket 10 has an outer diameter 10*a*, a step diameter 10*b*, and an inner diameter 10*c*. The outer diameter 10*a* is measured from the outer edge 16 of the gasket 10. The step diameter 10*b* is measured from the vertical leg 22 of the step 20. The inner diameter 10*c* is measured from the inner edge 18 of the step 20. Thus, the length of the top surface 12 can be calculated as the outer diameter 10*a* minus the step diameter 10*b*. The length of the horizontal leg 24 of the step 20 can be calculated as the step diameter minus the inner diameter 10*c*. Although the inner step 20 is illustrated as extending radially inward toward the center of the gasket 10, it is also possible to replace the inner step 20 with an outer step (not shown) that extends radially outward and away from the center of the gasket 20 (where the outer edge 16 defines the height 10*e*). It is also possible for the gasket 10 to have both an inner step 20 and an outer step.

Often, the gasket 10 is used for sealing a flanged joint on any number of mechanical elements, such as railcar hatches (including manways) and process piping. The outer diameter 10*a*, the step diameter 10*b*, the inner diameter 10*c*, the thickness 10*d*, and the height 10*e* (i.e., the dimensions) of the gasket 10 can vary depending upon the specific application. When used in combination with a railcar manway, example dimensions for the gasket 10 are an outer diameter 10*a* of about 21.50 inches (54.61 cm), a step diameter 10*b* of about 19.75 inches (50.17 cm), an inner diameter 10*c* of about 19.25 inches (48.90 cm), a thickness 10*d* of about 0.125 inches (0.318 cm), and a height of about 0.031 inches (0.079 cm).

Although the thickness 10*d* of about 0.125 inches (0.318 cm) for the gasket 10 will likely remain constant as a standard for many applications, the height 10*e* of the step 20 may change significantly. Thus, the height 10*e* may be 0.063 inches (0.159 cm), which is double the previous example height 10*e*, but preferably no larger. The two examples together define a range by which the height 10*e* extends relative to the thickness 10*d* of between about 25 to 50%. More generally, the thickness 10*d* may fall within the range of about 0.0625 to 0.250 inches (0.16 to 0.64 cm) and the height 10*e* may fall within the range of about 0.015 to 0.093 inches (0.038 to 0.236 cm).

Similarly, the width of the body (defined by the radial extent of the top surface 12) of the gasket 10 might remain constant as a standard for many applications at about 2.25 inches (5.72 cm). The width of the step 20 (defined by the radial extent of the horizontal leg 24) may vary, however, between 0.25 inches (0.64 cm) and 0.50 inches (1.27 cm). These examples together define a range by which the step 20 extends radially beyond the body of the gasket 10 of between about 11 to 22%. More generally, the width of the body may fall within the range of about 1.00 to 3.00 inches (2.54 to 7.62 cm) and the width of the step 20 may fall within the range of about 0.125 to 0.750 inches (0.318 to 1.905 cm).

Second Embodiment of Gasket

Figure 2:
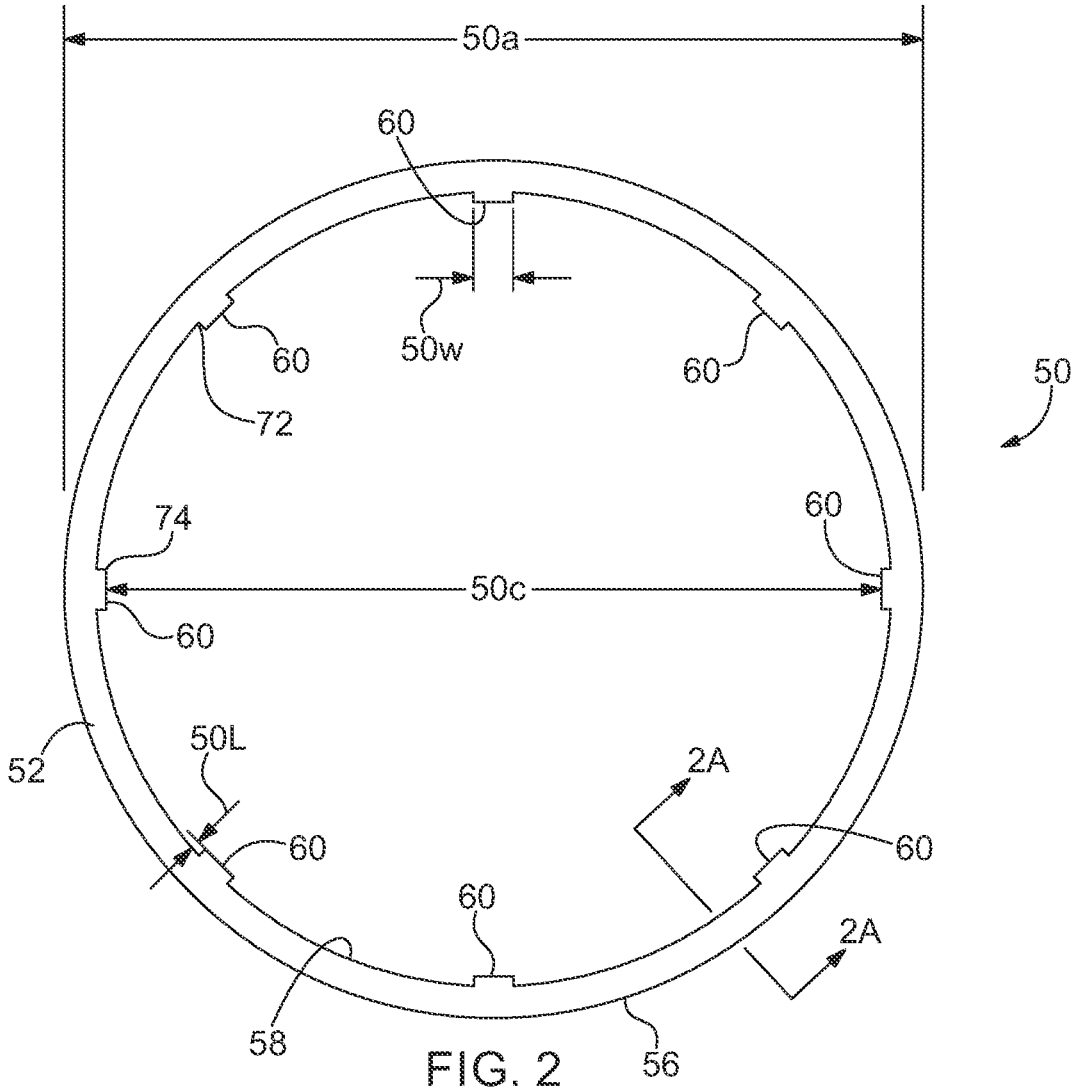
FIG. 2 is a top view of a second embodiment of a gasket according to the present disclosure.
Figure 2A:
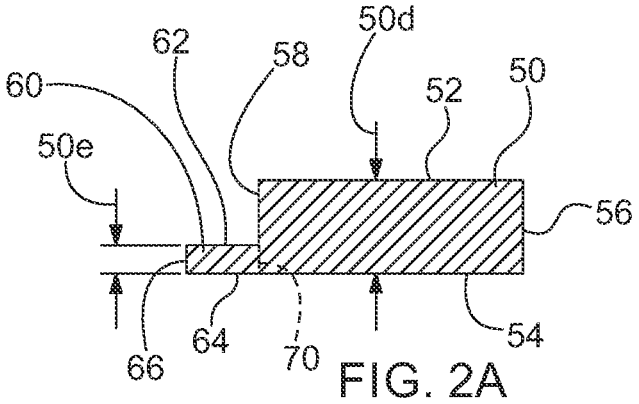
FIG. 2A is a cross-sectional view taken along the line 2A-2A of FIG. 2.

FIG. 2 is a top view of a second embodiment of a gasket, generally identified by the reference numeral 50, according to the present disclosure. FIG. 2A is a cross-sectional view taken along the line 2A-2A of FIG. 2. The gasket 50 has a substantially planar (flat) horizontal top surface 52 and a substantially planar (flat) horizontal bottom surface 54. The top surface 52 and the bottom surface 54 are substantially parallel. A substantially planar (flat) vertical outer edge 56 extends between the top surface 52 and the bottom surface 54 to define the height or thickness 50*d* of the gasket 50. A substantially planar (flat) vertical inner edge 58 extends downward from the top surface 52 and stops before reaching the bottom surface 54. If the inner edge 58 were extended along the dashed hypothetical extension line 70, the inner edge 58 would reach the bottom surface 54. The outer edge 56 and the inner edge 58 are substantially parallel. Therefore, the body of the gasket 50 is substantially a rectangle defined by the top surface 52, the bottom surface 54, the outer edge 56, and the inner edge 58 (as extended along the dashed hypothetical extension line 70).

The gasket 50 includes a plurality of tabs 60 that extend radially inward from the body of the gasket 50 toward the center of the gasket 50. Although eight tabs 60 are illustrated in FIG. 2, a person skilled in the art would envision any suitable number of tabs 60 as required by a particular application for the gasket 50. Thus, for example, the gasket 50 may have two, four, six, ten, or twelve tabs 60, or an odd number of tabs 60. Eight tabs 60 are preferred.

Each tab 60 has a substantially planar (flat) horizontal upper surface 62 and a substantially planar (flat) horizontal lower surface 64. The upper surface 62 and the lower surface 64 are substantially parallel. The lower surface 64 of the tab 60 is integral (flush) with the bottom surface 54 of the gasket 50 (i.e., the lower surface 64 and the bottom surface 54 lie in the same horizontal plane). The tab 60 ends in a substantially planar (flat) vertical inner surface 66 that extends between the upper surface 62 and the lower surface 64 to define the height 50*e* of the tab 60 of the gasket 50. The length of the inner edge 58 (without the dashed hypothetical extension line 70) can be calculated as the thickness 50*d* minus the height 50*e*. The inner surface 66 is substantially parallel to both the inner edge 58 and the outer edge 56. Therefore, the tab 60 of the gasket 50 is substantially a rectangle defined by the upper surface 62, the lower surface 64, the inner surface 66, and the dashed hypothetical extension line 70. The integral combination of the tabs 60 with the body (defined as that portion of the gasket 50 that lies under the top surface 52) forms the gasket 50.

The gasket 50 has an outer diameter 50*a* and an inner diameter 50*c*. The outer diameter 50*a* is measured from the outer edge 56 of the gasket 50. The inner diameter 50*c* is measured from the inner surface 66 of the tabs 60.

Each tab 60 has a length 50L, a width 50*w*, an inner radius of curvature 72 where the tab 60 meets the body of the gasket 50, and an outer radius of curvature 74 proximate the inner surface 66 of the tab 60. The inner radius of curvature 72 adds strength to the corners of the tabs 60. The outer radius of curvature 74 facilitates insertion of the gasket 50 in a particular application and enhances safety for a user 490 (see FIG. 10) who is handling the gasket 50. Although the tabs 60 are illustrated as extending radially inward toward the center of the gasket 50, it is also possible for the tabs 60 to extend radially outward from the outer edge 56 and away from the center of the gasket 50. It is also possible for the gasket 50 to have tabs 60 extending both radially inward and radially outward. When viewed from above, the tab 60 has a rectangular (and possibly a square) shape.

Often, like the gasket 10, the gasket 50 is used for sealing a flanged joint on any number of mechanical elements, such as railcar hatches (including manways) and process piping. The outer diameter 50*a*, the inner diameter 50*c*, the thickness 50*d*, the tab height 50*e*, the tab length 50L, the tab width 50*w*, the inner radius of curvature 72, and the outer radius of curvature 74 (i.e., the dimensions) of the gasket 50 can vary depending upon the specific application. When used in combination with a railcar manway, example dimensions for the gasket 50 are an outer diameter 50*a* of about 21.50 inches (54.61 cm), an inner diameter 50*c* of about 19.25 inches (48.90 cm), a thickness 50*d* of about 0.125 inches (0.318 cm), a tab height 50*e* of about 0.031 inches (0.079 cm), a tab length SOL of about 0.250 inches (0.635 cm), a tab width 50*w* of about 1.50 inches (3.81 cm), an inner radius of curvature 72 of about 0.045 inches (0.114 cm), and an outer radius of curvature 74 of about 0.045 inches (0.114 cm).

In addition to varying the number of tabs 60 provided on the gasket 50, the dimensions for each tab 60 can be varied depending upon the application. The width 50*w* of about 1.50 inches (3.81 cm) could vary by plus or minus 0.50 inches (1.27 cm) so that a suitable range for the width 50*w* is between about 1 inch (2.54 cm) and about 2 inches (5.08 cm). The length SOL of about 0.250 inches (0.635 cm) might increase to about 0.50 inches (1.27 cm) so that a suitable range for the length 50L is between about 0.250 inches (0.635 cm) and about 0.50 inches (1.27 cm). More generally, a suitable range for the length 50L is between about 0.125 inches (0.318 cm) and about 0.750 inches (1.91 cm). In addition, although all tabs 60 provided on a specific gasket 50 will typically have the same uniform dimensions, different tabs 60 may have different dimensions on the same gasket 50.

Although the thickness 50*d* of about 0.125 inches (0.318 cm) for the gasket 50 will likely remain constant as a standard for many applications, the height 50*e* of the tab 60 may change significantly. Thus, the tab height 50*e* may be 0.063 inches (0.159 cm), which is double the previous example tab height 50*e*, but preferably no larger. The two examples together define a range by which the tab height 50*e* extends relative to the thickness 50*d* of between about 25 to 50%. More generally, the thickness may fall within the range of about 0.0625 to 0.250 inches (0.159 to 0.635 cm) and the tab height 50*e* may fall within the range of about 0.015 to 0.093 inches (0.038 to 0.236 cm).

Similarly, the width of the body (defined by the radial extent of the top surface 52) of the gasket 50 might remain constant as a standard for many applications at about 2.25 inches (5.72 cm). The tab length 501, may vary, however, between 0.25 inches (0.64 cm) and 0.50 inches (1.27 cm). These examples together define a range by which the tab 60 extends radially beyond the body of the gasket 50 of between about 11 to 22%. More generally, the width of the body may fall within the range of about 1.00 to 3.00 inches (2.54 to 7.62 cm) and the tab length 50L may fall within the range of about to 0.750 inches (0.318 to 1.905 cm).

The preferred material of constructing either embodiment of the gasket 10, is the Durlon® 9000 inorganic-filled pure polytetrafluoroethylene (PTFE) resin. Durlon is a registered trademark of Gasket Resources Incorporated of Downingtown, Pennsylvania.

The preferred reinforced PTFE resin material has a minimum, maximum, and maximum continuous temperature capability, respectively, of about −212° C. (−350° F.); 271° C. (520° F.); and 260° C. (500° F.). The material can withstand a maximum pressure of about 103 bar (1,500 psi). Other material properties include a density of about 2.2 g/cc (138 lbs/ft$^3$), a compressibility of about 8-16%, a recovery of about 40%, a creep relaxation of about 30%, a tensile strength of about 13.8 MPa (2,000 psi), a sealability using ASTM 2378 (nitrogen) of about 0.01 cc/min, a volume resistivity using ASTM D257 of about $1.0\times10^5$ ohm-cm, and a dielectric breakdown using ASTM D149 of about 16 kV (406 V/mil). The leakage of the material is $7.55\times10^{-6}$ under conditions of 0.1 mbar (0.5 m), TA-Lull (VDI 2440), and iBar (14.5 psi) at 180° C. (392° F.).

Experimentally derived "constants" used to define the behavior of a gasket and/or the assembly and in-service conditions required for acceptable behavior are called "gasket factors." The term "gasket factor" comes from the ASME Boiler and Pressure Vessel Code, which contains tabulations of the m and Y factors mentioned for the first time in 1942. These two factors define the recommended gasket stress in-service and at assembly—for design purposes only. (Actual assembly and in-service stresses will usually be greater.)

In service, as soon as pressure is applied to the vessel, the initial gasket compression is reduced by the internal pressure acting against the gasket (blowout pressure) and the flanges (hydrostatic end force). To account for this, an additional preload must be placed on the gasket material. An "m" or maintenance factor has been established by ASME to account for this preload. The "m" factor defines how many times the residual load (original load minus the internal pressure) must exceed the internal pressure. In this calculation, the normal pressure and the test pressure should be taken into account. The factor "m" is defined by the ASME Code as a gasket factor or tightening factor, and is a multiplier applied to the value of the internal fluid pressure in order to obtain the necessary working gasket seating pressure. The maintenance factor "m" is dimensionless.

All gasket materials must have sufficient flange pressure to compress the gasket enough to insure that a tight, unbroken seal occurs. The flange pressure, or minimum seating stress, necessary to accomplish this is known as the "Y" factor. The factor "Y" is the required load in order to close the gasket porosity and to ensure compliance with the flange surface. The unit of measurement is psi. According to the ASME Code, "Y" is the pressure to seat the gasket in the flange and does not take into account the internal pressure which has to be contained in the service application. The "Y" factor is an empirical estimate only.

Relatively new factors, called $G_b$, "a," and $G_s$, have been developed for the Code. These factors are not design recommendations; rather, they define the behavior of the gasket. The factors $G_b$ and "a" give the gasket seating load and are similar to Y in the present Code. The factor $G_a$ is associated with the operating stress and is similar to the m value in the Code.

A 0.063 inch (0.159 cm) gasket made of the Durkin® 9000 material has the following parameters: m=2.2, Y=1, 937 psi (13.4 MPa), $G_b$=639 psi (4.4 MPa), a=0.220, and $G_s$=55 psi (0.379 MPa). A 0.125 inch (0.318 cm) gasket made of the material has the following parameters: m=4.6, Y=1,639 psi (11.3 MPa), $G_b$=495 psi (3.4 MPa), a=0.262, and $G_a$=65 psi (0.448 MPa).

Process of Manufacture

The gaskets 10, 50 can be manufactured in a number of ways. Two embodiments of the process of manufacturing the gaskets 10, 50 are outlined below.

Figure 3:
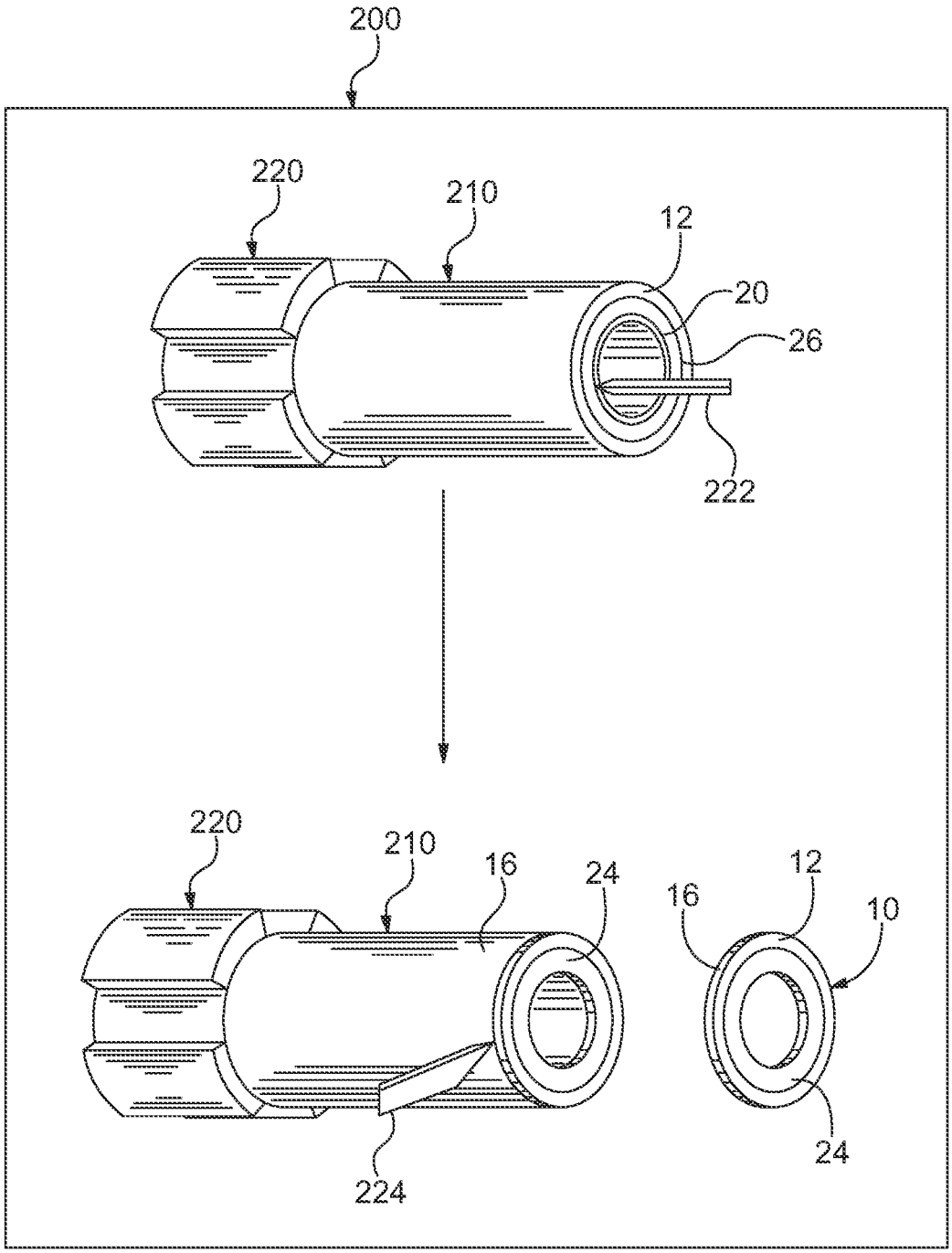
FIG. 3 illustrates two steps in one embodiment of the process used to manufacture the gasket shown in FIGS. 1 and 2.

The preferred process 200 of manufacturing the gaskets 10, 50 involves a billet 210 and a lathe 220. The process 200 comprises first the formation of the billet 210 from PTFE and a filler. The billet 210 can be extruded, molded, and/or machined into a cylindrical shape having a cylindrical surface and an end wall faced off perpendicular to the cylindrical surface. The billet 210 is then delivered to the lathe 220. FIG. 3 illustrates a perspective view of the billet 210 as held within the jaws of a chuck or a collet of the lathe 220 (or another machine for holding and rotating the billet 210 about its axis). The billet 210 may be a tube, as shown in FIG. 3, or a solid rod. In either case, the billet 210 has a predetermined outside diameter and, in the case of a tubular billet 210, a predetermined inside diameter, too. By "predetermined" is meant determined beforehand, so that the predetermined characteristic must be determined, i.e., chosen or at least known, in advance of some event (such as formation of the billet 210).

Depending upon the type of lathe 220 used in the process 200, a separate spindle (not shown) can be provided to rotate either the billet 210 or the lathe 220 relative to one another. Preferably, the billet 210 is rotated about its own central longitudinal axis. Such rotation allows a tool 222, which is carried by the lathe 220 so as to be able to move towards and away from the billet 210, to machine or cut a groove 26 in the exposed outer end of the billet 222. When complete, the groove 26 forms the inner step 20 of the gasket 10 as distinct from the top surface 12 of the gasket 10. Simultaneously with or sequentially after cutting the groove 26, if the billet 210 is a solid rod then the lathe 220 may also cut the center opening of the gasket 10, 50 having the inner diameter 10*c*, 50*c*.

The next step in the process 200 is to slice the gasket 10, 50 as shown in FIG. 3 from the free end of the billet 210. The slicing step can be accomplished with the use of a cutting tool such as a knife 224, which is carried by the lathe 220 so as to be able to move towards and away from the billet 210, and by rotating the billet 210 relative to the knife 224. Alternatively, however, the billet 210 may be stationary and the knife 224 may be rotated. As the lathe 220 operates, multiple gaskets 10, 50 are successively sliced from the billet 210. Each piece of the billet 210 that is sliced and severed from the billet 210 has the desired thickness 10*d*, 50*d* of the gasket 10, 50. Each slicing also simultaneously faces the billet 210 so that it is flat and ready for the next slice. This slicing operation is continued until the desired number of gaskets 10, 50 are produced or the billet 210 is consumed. Furthermore, if desired, the billet 210, after being held within the jaws of the chuck or a collet of the lathe 220 and before being machined and sliced, may have its inside and/or outside cylindrical surfaces machined to predetermined uniform diameters.

Once the gasket 10, 50 is sliced from the billet 210, the gasket 10 having the inner step 20 as shown in FIG. 1 may be ready for use. Alternatively, the gasket 50 having the tabs 60 requires an additional manufacturing step which is die-cutting the tab configuration after machining the inner step 20. The gasket 10 is placed in a forming die to complete the additional manufacturing step. In the die, the inner step 20 of the gasket is pierced, by a piercing element of the die, to cut the tabs 60 out of the inner step 20 precisely at the locations desired and exactly to the dimensions desired. This completes formation of the gasket 50 having the tabs 60 as shown in FIG. 2.

Another process that can be used to manufacture the gasket 10, 50 is a molding process. Although it has some very desirable material properties and characteristics, PTFE is a material that is not readily molded. Therefore, molding of PTFE tends to increase the expense of the manufacturing process. The process can vary depending upon the grade of the PTFE: melt-processable PTFE, which is rarely used in the molding manufacturing process due to cost, and granular PTFE. The melt-processable PTFE grade allows for injection molding and exhibits many of the same characteristics as the granular PTFE grade, but does not allow for the flexibility of molding and machining, which is why the preferred grade is granular PTFE.

Ail granular PTFE starts out as "low flow" or "non-free flow" which means it is the consistency of flour. Although it can flow into a mold, granular PTFE pours much like flour, which can be clumpy. Low flow can be blended with fillers to help improve some physical properties, such as wear, but can degrade tensile and friction. Tensile strength is usually not a problem, as most gaskets are in compression. Fillers will increase friction slightly. When fillers are mixed, or blended, into the base resin, they are milled to ensure uniform dispersion within the compound that is being created.

During the milling process, the mixture begins to get warm. Keeping the temperature low ensures that the fillers can be uniformly dispersed within the mixture. If the temperature does rise to the point at which the compound will no longer flow in the mill, clumping can occur. Materials will generally have multiple passes through the mill, but too many passes will begin to degrade the physical attributes in the base resin. Allowing the compound to rest after filling will allow the bulk temperature of the compound to return to room temperature. This helps the molder pack the material into the mold. If the compound is too warm during the molding process, voids can form in the mold, which will result in cracking in the gasket.

There are three basic molding processes that can be used to manufacture the PTFE gasket 10, 50: compression molding, isostatic molding, and automatic molding. All three have pros and cons; all three can yield a gasket that is functional in most applications. Physical properties will vary among the three processes. These variations are normally inconsequential. Automatic molding is generally done using pelletized material, which is referred to as free flow.

The molding process includes two steps. In the first step, powder is packed into the mold having the shape of the gasket 10, 50 and pressed in its "green state." This step is then followed by sintering to alter the molecular state of the compound. After packing the mold and pressing the material, the material is then removed from the mold. This removal process is a critical procedure while the compound is in the green or un-sintered state. Any mishandling of the green material will result in cracks.

The sintering process (the second step of the molding process) results in a change in the compound, allowing the molecules to reorganize. This process step makes the material a compound rather than a mixture, and the compound cannot be returned to its original constituents after sintering. There is a science to proper sintering of PTFE. To summarize, however, sintering is done between 357 and 371° C. (675 and 700° F.). Sintering must be done in an oven to insure good airflow. A carefully selected oven cycle will ensure the material is properly sintered, which usually includes an annealing cycle to enhance physical properties and prevent cracks from forming. After cooling to room temperature, the material is ready to be machined.

Free flow is a secondary process that pelletizes the material, allowing it to flow into the mold more easily. Free flow lends itself to automatic molding due to the non-clumping of the material. Physical properties from free flow will generally be less desirable than low flow. But the molding process may often bring material physical properties close to the low flow. Automatic molding often allows for the autofill of the material into the mold, saving manufacturing costs. Automatic molding may also result, however, in surface finish issues on the finished gasket 10, 50. In general, the processing of granular PTFE results in excellent gaskets 10, 50 for a wide variety of sealing applications.

Using one of the embodiments of the process discussed above to manufacture the gasket 10, 50, waste generated during the manufacturing process is reduced. Conventional gasket manufacturing techniques in which circular gaskets are cut from rectangular or square PTFE sheets may result in 40% to 60% of PTFE sheet waste. Considering that PTFE does not degrade with time, even when exposed to sunlight and other environmental effects, the reduction of PTFE sheet waste in the manufacturing process is desirable. By using the disclosed and preferred process, the gaskets 10, 50 are manufactured from a tubular or solid billet 210 without generating PTFE sheet waste. Generally, the process results in cost savings compared to conventional manufacturing methods of PTFE gaskets.

In addition, using the process, the outer diameter 10*a*, 50*a* of the gasket 50 and the inner diameter 10*c*, 50*c* of the gasket 10, 50 are not limited by the size of a PTFE sheet. Although conventional gaskets may be spliced together to form a large-sized gasket, the gaskets 10, 50 are integral and splice-free. In addition, the inner step 20 of the gasket 10 and the tabs 60 of the gasket 50 are integral with the body of the respective gasket. Conventional methods often glue projections onto a circular gasket. Generally, splices and glued projections are detrimental to gasket performance because the areas of the gasket that contain the splice or projection are weak, which can cause leaks or blowouts. The disclosed processes yield integral, splice-free, and glue-free large gaskets.

Example Application

Figure 4:
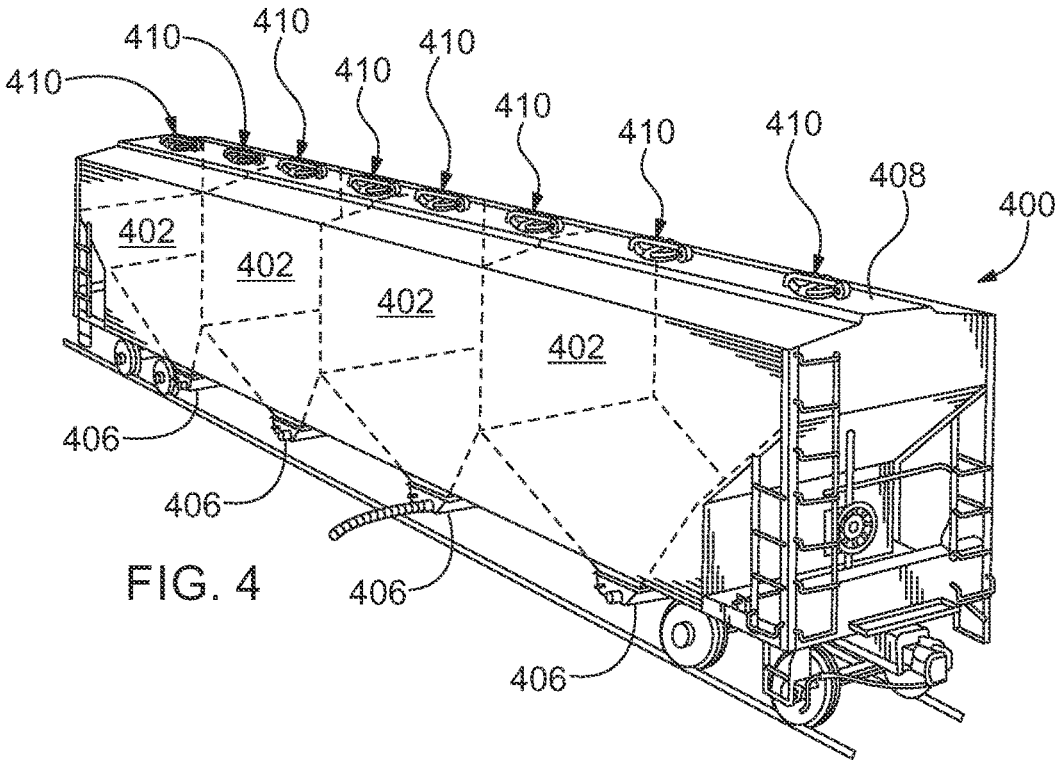
FIG. 4 is a perspective side view of a railway car that uses the gasket shown in FIGS. 1 and 2.

FIG. 4 is a perspective side view of a railway car 400 that uses the gaskets 50 of the present disclosure. In the exemplary embodiment, the railway car 400 is a closed-top railway hopper car but the gasket 10, 50 can be used with any conventional railway car 400. The railway car 400 can be used to store and/or transport any suitable granular and/or flowable commodity material. The railway car 400 includes a plurality of compartments 402, each having one or more loading nozzles or hatches 404 located in the roof 408 of the railway car 400 and at the top of one or more of the compartments 402. A hatch cover 410 is provided for each hatch 404. The railway car 400 may also include a discharge or outlet 406 located at the bottom of one or more of the compartments 402.

Figure 5:
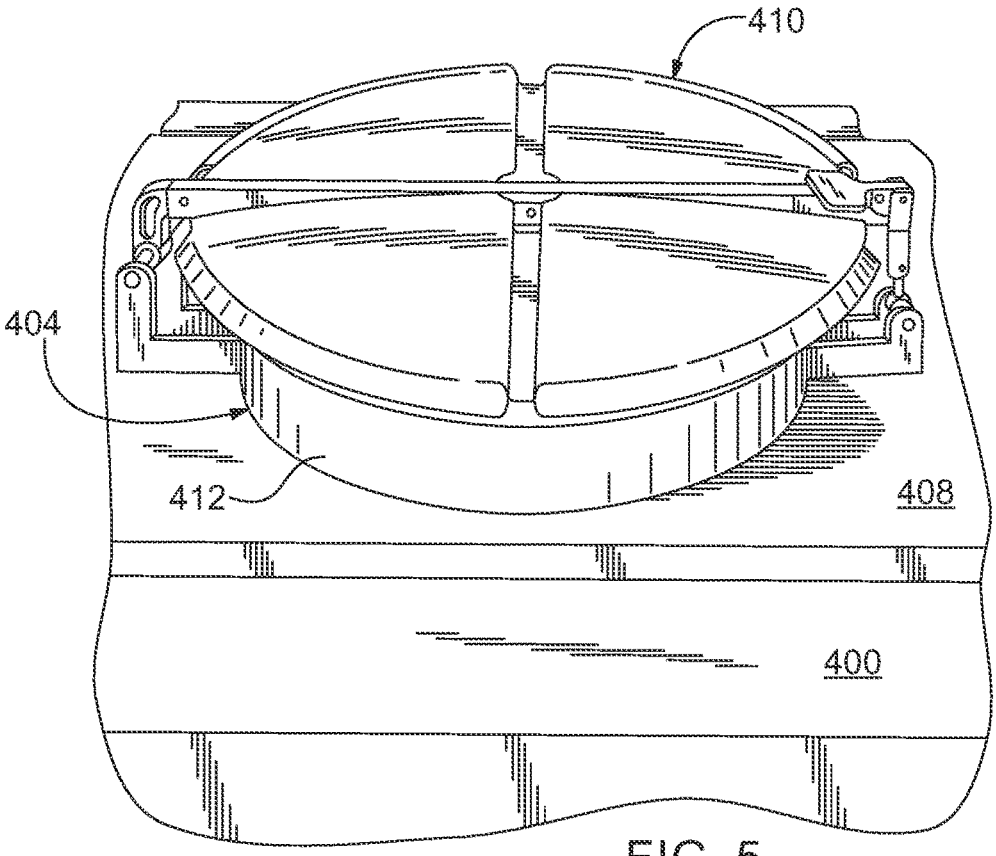
FIG. 5 is an overhead perspective view of the hatch cover in position over the hatch on the roof of the railway car shown in FIG. 4.

The compartments 402 receive and store materials being transported by the railway car 400. The hatches 404 are used for loading materials into the compartments 402 and for venting the compartments 402 during the unloading process and during transit. Although the railway car 400 illustrated in FIG. 4 has four compartments 402 and each compartment 402 has one outlet 406 and two hatches 404, it should be appreciated that the number of compartments 402, outlets 406, and hatches 404 could vary and that the hatch cover 410 could be mounted on any number of hatches 404. It also should be appreciated that although the hatch 404 and the hatch cover 410 illustrated and described below are circular in shape, the gaskets 10, 50 of the present disclosure may be used with a hatch and hatch cover of various shapes. For example, the hatch 404 and the hatch cover 410 may be rectangular in shape, where several hatch covers 410 would be provided for closing several hatches 404 on the railway car 400. In addition, the hatch 404 could be trough-shaped, and closable by an elongated hatch cover 410 that may itself have a plurality of smaller individual covers 410. Common to all hatches 404 would be a peripheral gasket seat or pocket 416 for receiving the gasket 10, FIG. 5 is an overhead perspective view of the hatch cover 410 in position over the hatch 404 on the roof 408 of the railway car 400. Each hatch 404 includes an annular coaming 412 extending upwardly from the roof 408 of the railway car 400. The coaming 412 defines a circular hatch opening for the compartment 402. An annular flange extends around the top of the coaming 412, although not all hatches 404 have a flange. The hatch cover 400 includes the gasket 10, 50 to form a substantially airtight seal between the hatch 404 and the hatch cover 410, and more particularly between the hatch cover 410 and the annular flange or coaming 412 of the hatch 404.

Figure 6:
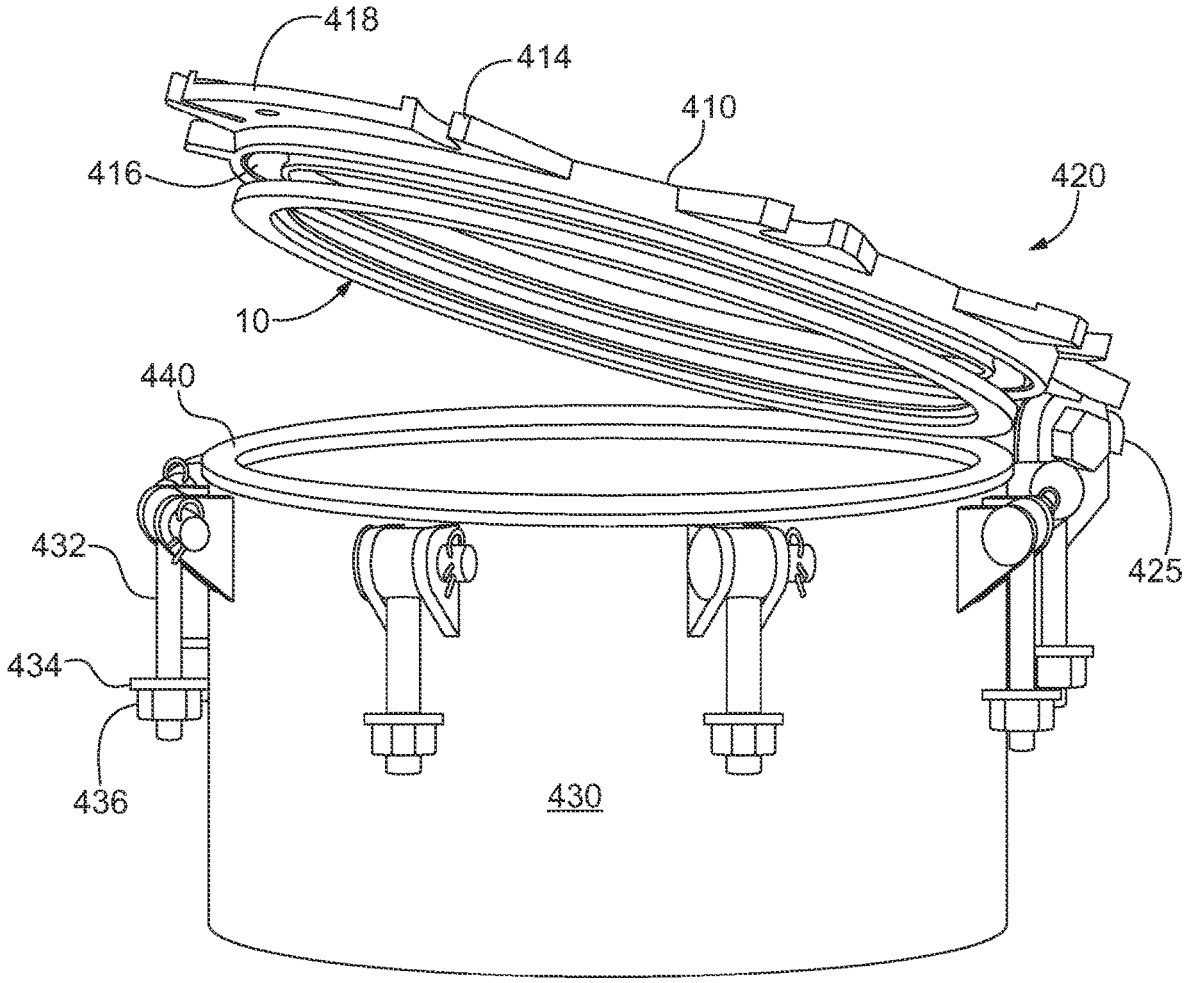
FIG. 6 illustrates an example of one type of a hatch cover, namely, a manway cover which is part of a manway system.

The gaskets 10, 50 of the present disclosure may work with any hatch cover 410 that contains the gasket-receiving pocket 416. An example of one type of hatch cover is shown in FIG. 6, namely, a manway cover 410 which is part of a manway system 420. The manway system 420 is highlighted given its importance to the rail industry from a sealing perspective.

Both the rail industry and the U.S. government are seeking to reduce the volume and severity of leaks from railcars. They define non-accident releases (NARs) as the unintentional release of a hazardous material while in transportation, including loading and unloading while in railroad possession, that is not caused by a derailment, collision, or other rail-related accident. NARs consist of leaks, splashes, and other releases from improperly secured or defective valves, fittings, and tank shells. The Association of American Railroads (founded in 1934, the AAR is the world's leading railroad policy, research, standard setting, and technology organization that focuses on the safety and productivity of the U.S. freight rail industry; see www.aar.org) began tracking NARs in 2001, gathering data on the impact of sealing on industry performance and safety. Of the more than fourteen seals on a typical railcar, particular attention needs to be given to tank car manway systems, which are responsible for more than 60% of such releases in general service cars, according to the AAR. Understanding and reducing NARs in the rail industry is an important goal for both the industry and general public.

General service cars transport fluids such as crude oil, styrene, biofuels, fuel oil, sodium hydroxide, and others. These cars represent more than a quarter of the U.S. and Canadian fleets (AAR 2014 data), and are the primary source of NARs in North America. Fifteen years of tracking NARs has identified the primary cause of NARs in this fleet as the manway system 420. Further investigation has revealed that loose fasteners and gasket deterioration were responsible for 74% of all documented leaks.

These data point to the conclusion that the most effective way to decrease NARs in a fleet is to focus on the manway first. The need for proper gasket selection and installation is a critical part to an effective manway seal. Maximizing operational uptime, minimizing maintenance, and improving safety require effectively sealing manway systems 420. Success is subject to a number of variables, including the gasket, loading conditions, installation methods, and mechanical integrity of the manway system 420 (specifically the nut-and-bolt assemblies) and sealing surfaces.

As shown in FIG. 6, the manway system 420 includes the manway cover 410 rotatably connected to a manway nozzle 430 via a spring-assisted hinge 425. The manway cover 410 has a groove or gasket-receiving pocket 416, configured to receive the gasket 10, 50. The manway cover 410 also has a handle 418 that facilitates rotation by a user of the manway cover 410. Proximate the handle 418 on the manway cover 410 are a number of eyebolt slots 414. Dispersed uniformly around the circumference of the manway nozzle 430 are six-to-eight swing eyebolts 432, each with a hardened washer 434 and an eyebolt nut 436. The eyebolts 432 engage the eyebolt slots 414 to seal and lock the manway system 420 when the manway cover 410 is closed on the manway nozzle 430. The manway nozzle 430 may have an optional rubber-based nozzle seal 440 located around its top rim.

As an aside, distinguish a washer like the washer 434, which distributes the load of a fastener, from a gasket like the gasket 10, 50, which prevents leaks around mating surfaces. More specifically, a washer is a type of disc-shaped fastener with a hole in the center. Washers are typically used to distribute the load of a threaded fastener, such as a bolt. The bolt slides through the hollow center of a washer, after which the bolt is twisted or otherwise installed on an object. The washer will then distribute the load of the bolt across its disc-shaped surface. In contrast, a gasket is a sealing device that is used to prevent leaks around the mating surface where two or more objects meet. Gaskets typically are not used with fasteners. Rather, gaskets are used with machines and machinery components. Machines often have passages through which air, oil, coolant, or other fluids and gases travel. The mating surfaces between these passages are equipped with a gasket to prevent them from leaking.

Corrosion and damaged components in the manway system 420 are common, given the operational duty cycles and long service lives of the railway cars. As of 2015, the average age of the 312,581 tank cars in the United States was 15.4 years (AAR data), indicating the increased likelihood that corrosion has impacted the entire fleet in some manner. Commonly, this corrosion impacts the gasket through damaged sealing surfaces and/or corroded fasteners.

Miscommunication of gasket sizes and variability of the physical surface on which the gasket rests regularly result in products being used outside their recommended loading conditions. For example, a highly beveled manway nozzle 430 (versus a nozzle face that is machined flat) will have a significantly reduced contact surface. This configuration means the same bolt load is distributed over a smaller surface area, leading to an increase in gasket stress. Similarly, miscommunication on gasket size and contact area can result in incorrect torque calculations, leading to significant installation errors. In both these and similar cases, the result is a gasket performing at stresses far less or far greater than intended. Often the higher torque values used to seal hard gaskets are applied to soft rubber gaskets. This creates compressive stresses far greater than what the soft gasket can accommodate, causing it to crush and split, dropping half a gasket into the railway car 400 and leaving a manway system 420 susceptible to a NAR. These scenarios highlight the critical importance of gasket selection and loading. See Wayne Evans, "Sealing tank car manways to prevent NARs," Railway Age (Aug. 22, 2016) (available at www.railwayage.com/regulatory/sealing-tank-car-manways-to-prevent-nars/).

Figure 7A:
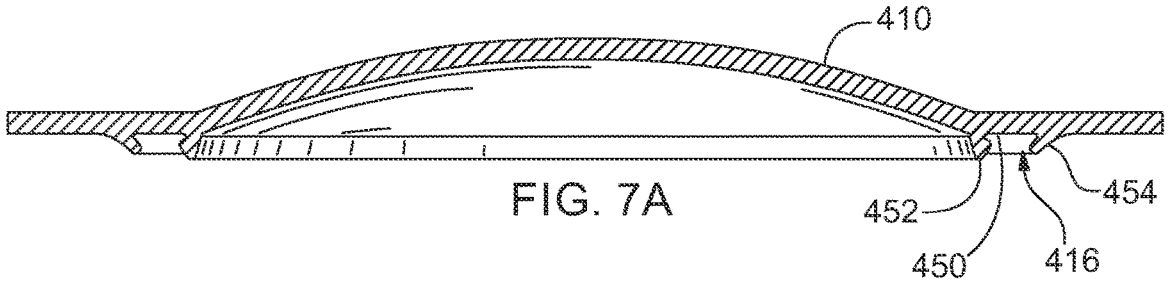
FIGS. 7A, 7B, and 7C are schematic cross-sectional views that focus on or highlight the seal between the manway cover and the manway nozzle of the manway system and, more specifically.
Figure 7B:
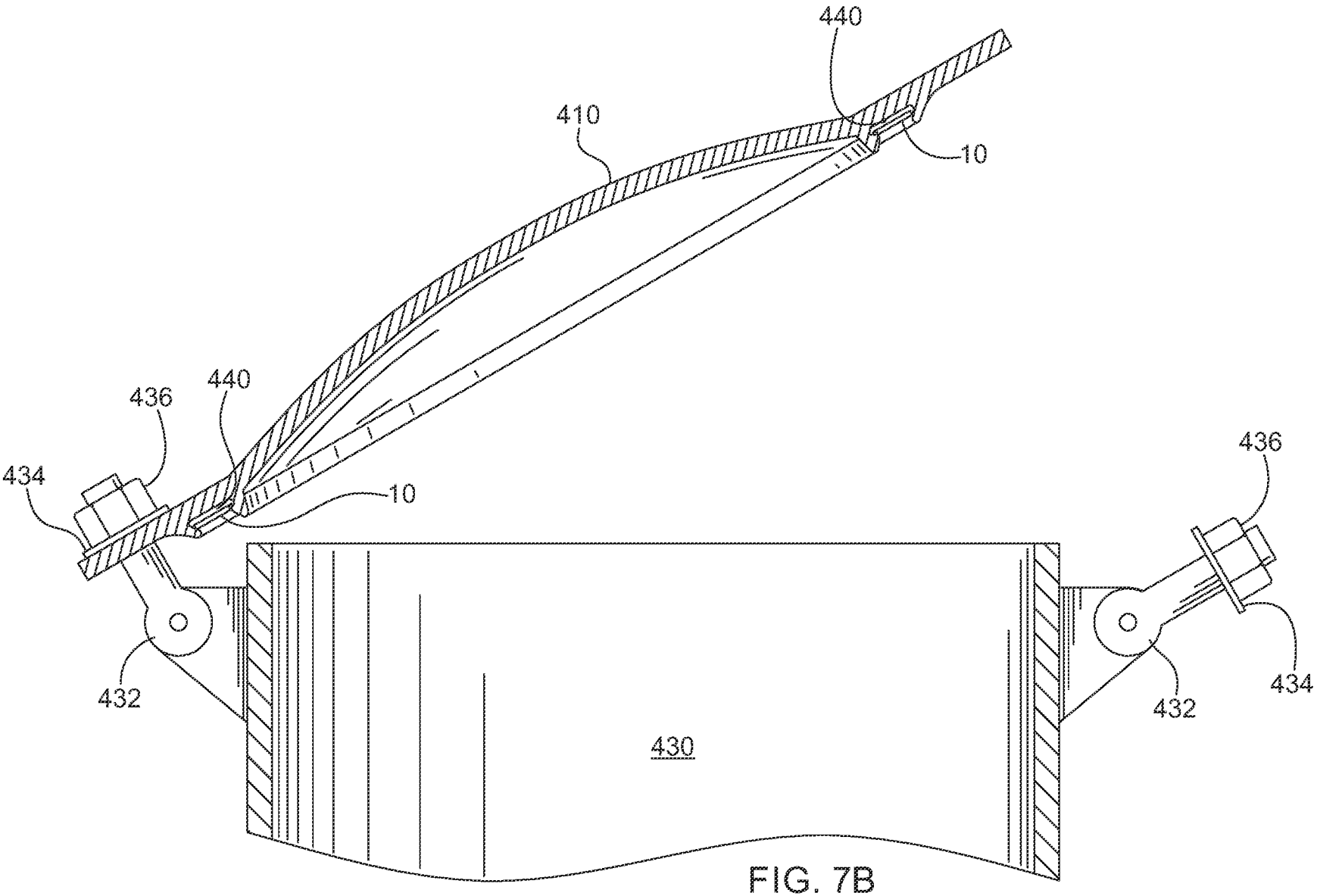
Figure 7C:
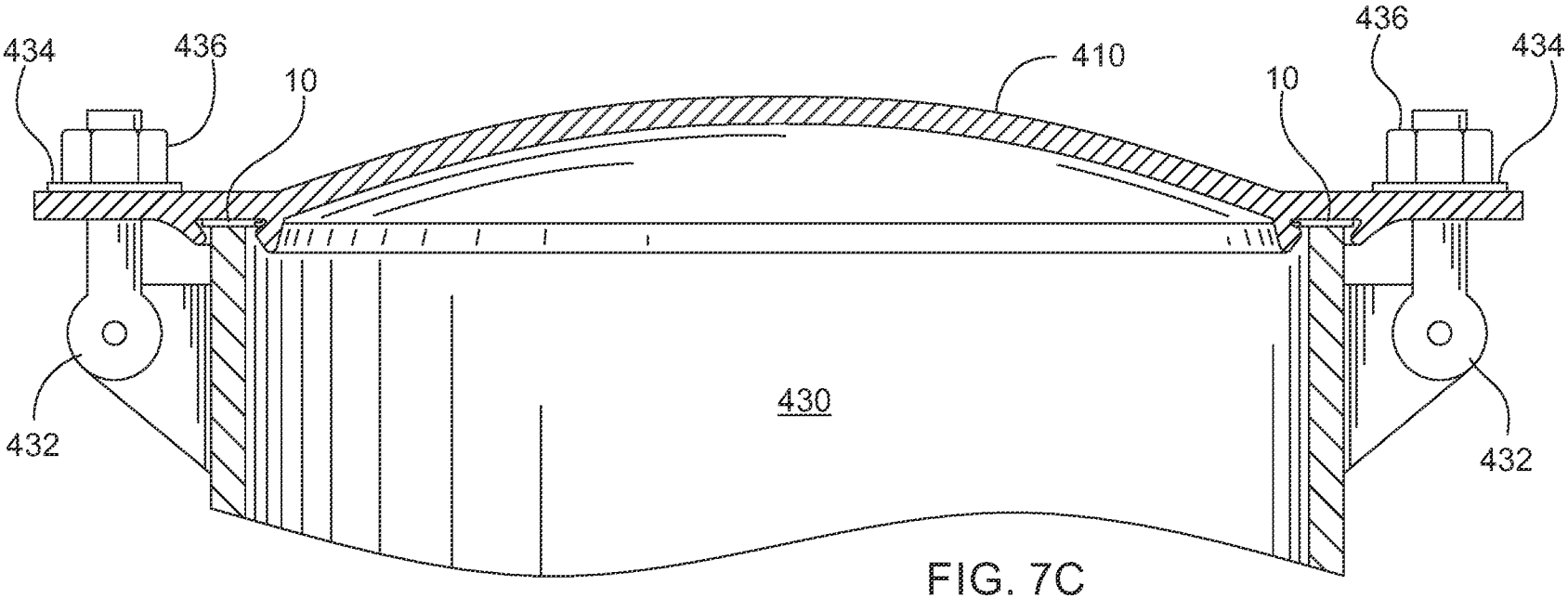

FIGS. 7A, 7B, and 7C are schematic cross-sectional views that focus on or highlight the seal between the manway cover 410 and the manway nozzle 430 of the manway system 420 using the gasket 10, 50. FIG. 7A illustrates the manway cover 410 having the gasket-receiving pocket 416. The gasket-receiving pocket 416 has a substantially flat and horizontal head 450, a first downwardly extending flange 452, and a second downwardly extending flange 454 that combine to define a seat for the gasket 10, 50. The gasket-receiving pocket 416 is disposed circumferentially and continuously around the underside and near the perimeter of the manway cover 410.

FIG. 7B illustrates the manway cover 410 with the gasket 10 snapped into place within the gasket-receiving pocket 416. (Of course, the gasket 50 could be snapped into place instead of the gasket 10.) In FIG. 7B, the manway cover 410 is in its open position and is not closed against the manway nozzle 430. Note that the gasket 10 is not pushed against the head 450 of the gasket-receiving pocket 416 when the manway cover 410 is open.

FIG. 7C illustrates the manway cover 410 in position over and locked with (so that the manway cover 410 closes) the manway nozzle 430, with the gasket 10 in place. This position is the "bolted up" position for the manway system 420. Two of the plurality of eyebolts 432, each with a hardened washer 434 and an eyebolt nut 436, are shown. The eyebolts 432 engage the eyebolt slots 414 to seal and lock the manway system 420 when the manway cover 410 is closed on the manway nozzle 430. Note that the gasket 10 is pushed against the head 450 of the gasket-receiving pocket 416 when the manway cover 410 is closed and locked.

Figure 8A:
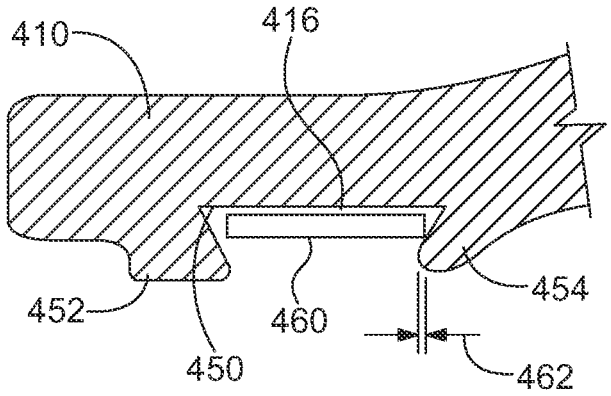
FIG. 8A (PRIOR ART)
FIGS. 8A, 8B, and 8C are schematic cross-sectional views that illustrate a conventional gasket retained in the pocket of the manway cover and, more specifically.
Figure 8B:
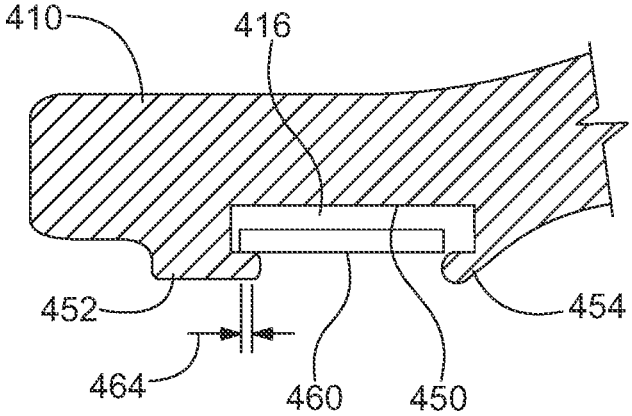
FIG. 8B (PRIOR ART)
Figure 8C:
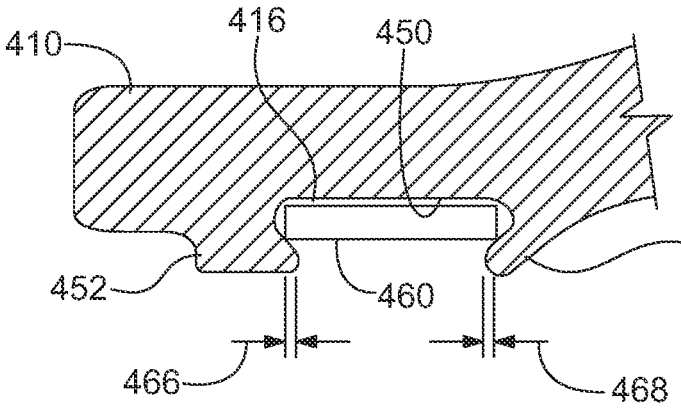
FIG. 8C (PRIOR ART)

FIGS. 8A, 8B, and 8C are schematic cross-sectional views that illustrate a conventional gasket 460 retained in the pocket 416 of the manway cover 410. These figures are reproduced from FIG. E.26 of Appendix E of the *AAR Manual of Standards and Recommended Practices Specifications for Tank Cars* at C-III [M-1002] 326 (November 2014). The gaskets shown in these figures illustrate retention methods and overlaps required. Any of the conventional gaskets could be used in any of the pockets 416 shown. More specifically, FIG. 8A shows a hard gasket 460 retained on the inner diameter of the manway cover 410 with a first nominal overlap 462 of about 0.0625 inches (0.159 cm). FIG. 8B shows a hard gasket 460 retained on the outer diameter of the manway cover 410 with a second nominal overlap 464 of about 0.0625 inches (0.159 cm). FIG. 8C shows an elastomeric gasket 460 retained on both the inner and outer diameter of the manway cover 410 with a third nominal overlap 466 of about 0.03125 inches (0.0794 cm) and a fourth nominal overlap 468 of about 0.0625 inches (0.159 cm). In all three cases, the conventional gaskets 460 are retained by the manway cover 410 by overlapping the pockets 416 on the inside edge at the first flange 452 or on the outside edge at the second flange 454.

Figure 9:
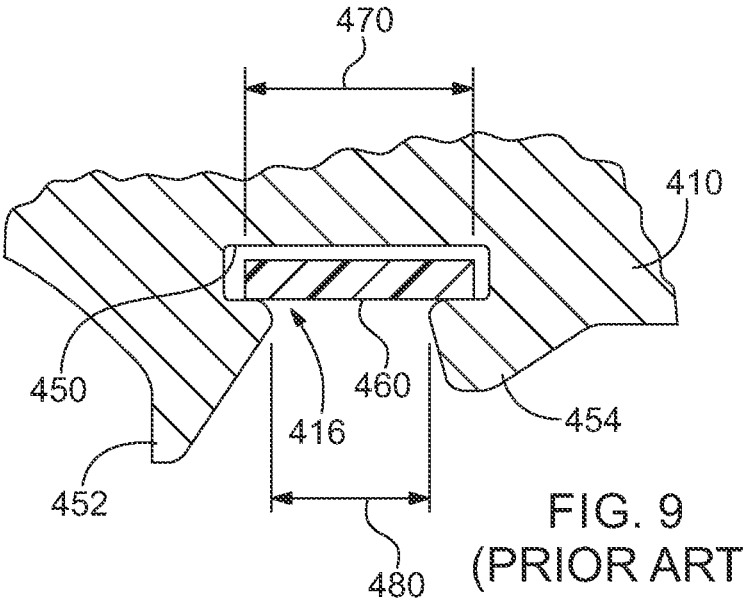
FIG. 9 (PRIOR ART)
FIG. 9 illustrates a problem identified for a conventional gasket configured to engage the pocket of the manway cover.

FIG. 9 illustrates a problem identified for the conventional gasket 460 configured to engage the pocket 416 of the manway cover 410. The conventional gasket 460 has an outer diameter (i.e., a first dimension) 470 that is equal to or greater than the opening distance (i.e., a second dimension) 480 defined by the opening to the pocket 416. The opening distance 480 is the distance between the first flange 452 and the second flange 454. Therefore, the conventional gasket 460 must deform to pass through the opening and be seated in the pocket 416.

A problem with the conventional gasket 460, which is the cause of many NARs, is that the conventional gasket 460 has to be precisely sized to (a) allow insertion through the opening and into the pocket 416, yet (b) remain in place in the pocket 416 once inserted. The tight tolerances required for the conventional gasket 460 are difficult to achieve, and yield scrap parts when the tolerances are not achieved, during manufacture. In addition, when the conventional gasket 460 is too small, installation becomes difficult and, in some cases, impossible. On the other hand, an overly large conventional gasket 460 will easily exit the pocket 416 and may fall into the manway nozzle 430. In either case, the pocket 416 will lack a gasket, which may result in leaks, splashes, and other releases from an improperly secured manway cover 410.

Figure 10:
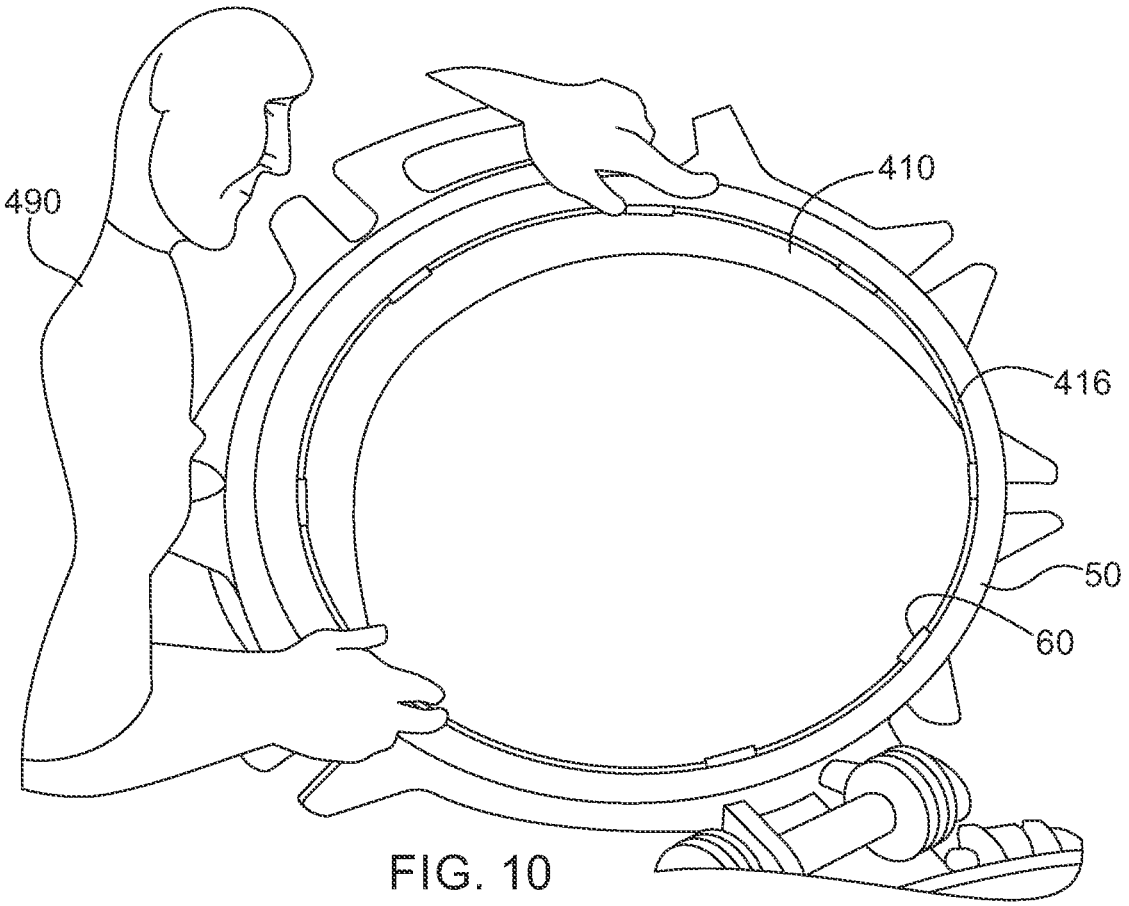
FIG. 10 depicts a user snapping the gasket shown in FIG. 2 into place within the pocket of the manway cover.

In order to prevent NARs, and to achieve other advantages, the gaskets 10, of the present disclosure replace the conventional gasket 460. The specific dimensions of the gaskets 10, 50 and the flexibility offered by the inner step 20 of the gasket 10 and by the tabs 60 of the gasket 50, allow the gaskets 10, 50 to properly snap into place within the pocket 416 of the manway cover 410. FIG. 10 shows a user 490 snapping the gasket 50 having eight tabs 60 into place within the pocket 416 of the manway cover 410. Although not shown, the gasket 10 having the inner step 20 similarly snaps into place. To highlight the importance of the specific dimensions of the gaskets 50 to their functionality, the applicant tested a gasket having eight tabs that was the same uniform thickness (namely, 0.125 inches or 0.318 cm) throughout (i.e., without any step) and the gasket would not snap into place—even when using tabs having a width of about 0.50 inches or 1.27 cm.

The increased flexibility of the gaskets 10, 50 enables the user 490 to install the gaskets 10, 50 more quickly than the conventional gasket 460. The gaskets 10, easily snap into the pocket 416. Consequently, the time required to install the gaskets 50 may be approximately 30 seconds, while the time required to install the conventional gasket 460 may be up to 5 minutes. Thus, the time required to install the gaskets 10, 50 in the pocket 416 is significantly less than the time required to install the conventional gasket 460.

The flexibility of the gaskets 10, 50 also renders the gaskets 10, 50 more versatile than the conventional gasket 460. In addition, as between the two gaskets 10 and 50, the gasket 50 having the tabs 60 is more versatile than the gasket 10 having the inner step 20 because the tabs 60 are not as restrictive as the solid inner step 20 on installation. Regardless, the gaskets 10, 50 will accommodate more than one style of manway system 420 (depending, of course, on end user approval) meaning that distributors can stock one size of gasket 10, 50 for multiple manway designs, therefore reducing inventory and overall cost.

The inner step 20 on the gasket 10 and the tabs 60 on the gasket 50 also help to block the undesired accumulation in the pocket 416 of the manway cover 410 either of debris or of the commodity transported in the compartment 402 of the railway car 400. The surfaces and faces of the gaskets 10, 50 are smooth and flat, without knurling or roughness, to facilitate handling and to assure a consistent seal. Although the application of the gaskets 10, 50 in the pocket 416 of the manway cover 410 is highlighted above, an artisan would realize that the gaskets 10, 50 have many other applications. In fact, any application having a groove design similar to the pocket 416 would be a candidate for the gaskets 10, 50.

Although illustrated and described above with reference to certain specific embodiments and examples, the present disclosure is nevertheless not intended to be limited to the details shown. Rather, various modifications may be made in the details within the scope and range of equivalents of the claims and without departing from the spirit of the disclosure.

What is claimed:

1. A gasket used to prevent leaks around the mating surface where two or more objects meet, the gasket comprising:

a substantially planar horizontal top surface defining a body under the top surface;

a substantially planar horizontal bottom surface substantially parallel to the top surface;

a substantially planar vertical edge extending between the horizontal top surface and the horizontal bottom surface to define the thickness of the gasket; and a step that is integral with the body and has an "L" shape defined by a substantially planar vertical leg and a substantially planar horizontal leg, the step having a bottom flush with the horizontal bottom surface and ending in a substantially planar vertical edge that extends between the bottom and the horizontal leg to define the height of the step wherein the height is less than the thickness.

2. The gasket according to claim 1, wherein the thickness of the gasket is about 0.32 cm.

3. The gasket according to claim 1, wherein the height of the step is between about 25 to 50% relative to the thickness of the gasket.

4. The gasket according to claim 1, wherein the step extends radially beyond the body of the gasket by about 11 to 22%.

5. The gasket according to claim 1, wherein the step is divided into a plurality of separate tabs.

6. The gasket according to claim 5, wherein each tab is substantially rectangular in cross section.

7. The gasket according to claim 5, wherein each tab has an inner radius of curvature where the tab meets the body of the gasket, which adds strength to the tab, and an outer radius of curvature which facilitates insertion of the gasket in a particular application and enhances safety for a user who is handling the gasket.

8. The gasket according to claim 1, wherein the gasket is made of an inorganic-filled pure polytetrafluoroethylene resin.

9. A railway car comprising:

a gasket according to claim 1;

a roof having a hatch; and a cover configured to open and close the hatch, the cover having a pocket configured to receive the gasket, wherein the cover seals against the hatch when closed.

10. The railway car according to claim 9, wherein the gasket is configured to snap into place within the pocket.

11. The railway car according to claim 10, wherein a user can snap the gasket into place within the pocket in about 30 seconds or less.

12. A process for manufacturing a gasket, the process comprising the steps of:

(a) forming a billet having an exposed outer end;

(b) delivering the billet to a lathe;

(c) holding the billet within the jaws of a chuck or a collet of the lathe;

(d) rotating either the billet or the lathe relative to one another;

(e) moving a tool towards and away from the billet to machine or cut a groove in the exposed outer end of the billet such that, when complete, the groove forms a step in the gasket, the gasket comprising:

a substantially planar horizontal top surface defining a body under the top surface;

a substantially planar horizontal bottom surface substantially parallel to the top surface;

a substantially planar vertical edge extending between the horizontal top surface and the horizontal bottom surface to define the thickness of the gasket; and wherein the step is integral with the body and has an "L" shape defined by a substantially planar vertical leg and a substantially planar horizontal leg, the step having a bottom flush with the horizontal bottom surface and ending in a substantially planar vertical edge that extends between the bottom and the horizontal leg to define the height of the step wherein the height is less than the thickness;

(f) optionally cutting a center opening of the gasket; and (g) slicing the gasket from the billet.

13. The process according to claim 12, further comprising the step of die cutting tabs from the step.

14. The process according to claim 12, wherein the billet is made of an inorganic-filled pure polytetrafluoroethylene resin.

15. The process according to claim 12, wherein no sheet waste is generated.

* * * * *